US010398264B2

(12) United States Patent
Rozek et al.

(10) Patent No.: US 10,398,264 B2
(45) Date of Patent: Sep. 3, 2019

(54) MECHANICAL DISPENSER FOR PERFORATED SHEET PRODUCTS

(71) Applicant: GPCP IP Holdings LLC, Atlanta, GA (US)

(72) Inventors: Roy J. Rozek, Neenah, WI (US); Matthew K. F. Williquette, Sobieski, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 319 days.

(21) Appl. No.: 15/416,740

(22) Filed: Jan. 26, 2017

(65) Prior Publication Data

US 2017/0209006 A1 Jul. 27, 2017

Related U.S. Application Data

(60) Provisional application No. 62/286,993, filed on Jan. 26, 2016.

(51) Int. Cl.

| | |
|---|---|
| ***A47K 10/40*** | (2006.01) |
| ***A47K 10/38*** | (2006.01) |
| ***A47K 10/36*** | (2006.01) |

(52) U.S. Cl.

CPC ..... *A47K 10/40* (2013.01); *A47K 10/3827* (2013.01); *A47K 2010/3681* (2013.01); *A47K 2010/3863* (2013.01)

(58) Field of Classification Search

CPC ..... A47K 10/3827; A47K 10/40; A47K 2010/3233; A47K 2010/3681; A47K 2010/3863

See application file for complete search history.

(56) References Cited

U.S. PATENT DOCUMENTS

| | | | |
|---|---|---|---|
| 1,540,876 | A | 6/1925 | Dwyer |
| 1,703,594 | A | 2/1929 | Pratt |
| 2,390,399 | A | 12/1945 | Tator et al. |
| 2,637,503 | A | 5/1953 | Birr |
| 2,668,022 | A | 2/1954 | Fairfield |
| 2,693,321 | A | 11/1954 | Birr |
| 2,726,823 | A | 12/1955 | Jespersen |
| 2,852,158 | A | 9/1958 | Jones et al. |
| 2,993,658 | A | 7/1961 | Sweeney |
| 3,040,943 | A | 6/1962 | Bump |
| 3,592,161 | A | 7/1971 | Hoffmann |

(Continued)

FOREIGN PATENT DOCUMENTS

| | | | |
|---|---|---|---|
| JP | 6351254 | 3/1988 | |
| WO | WO-9638371 A1 * | 12/1996 | ..... B65H 35/002 |

(Continued)

OTHER PUBLICATIONS

International Search Report for International Application No. PCT/US2017/015023, mailed by the International Searching Authority dated May 16, 2017.

(Continued)

*Primary Examiner* — William E Dondero

(57) ABSTRACT

The present application provides a dispenser for a roll of sheet product. The dispenser may include a housing with a first wall, a discharge chute, and a roll support mechanism positioned within the housing. The roll support mechanism forces the roll against the first wall at a fixed contact area.

30 Claims, 11 Drawing Sheets

(56) References Cited

U.S. PATENT DOCUMENTS

| | | | |
|---|---|---|---|
| 3,861,985 | A | 1/1975 | Parlagreco et al. |
| 3,995,582 | A | 12/1976 | Douglas |
| 4,467,974 | A | 8/1984 | Crim et al. |
| 4,621,755 | A | 11/1986 | Granger |
| 4,691,503 | A | 9/1987 | Frerich |
| 4,793,539 | A | 12/1988 | Haenni et al. |
| 5,054,676 | A | 10/1991 | Ban |
| D327,799 | S | 7/1992 | Addison et al. |
| 5,228,632 | A | 7/1993 | Addison et al. |
| D348,379 | S | 7/1994 | Parella |
| 5,325,992 | A | 7/1994 | Koller et al. |
| 5,439,521 | A | 8/1995 | Rao |
| 5,630,526 | A | 5/1997 | Moody et al. |
| D405,655 | S | 2/1999 | Michaeli |
| 5,868,275 | A | 2/1999 | Moody et al. |
| 6,257,443 | B1 | 7/2001 | LaCount |
| 6,561,598 | B2 | 5/2003 | Granger |
| 6,592,013 | B1 | 7/2003 | Fujiwara |
| 6,684,751 | B2 | 2/2004 | Kapiloff et al. |
| 6,860,447 | B2 | 3/2005 | Boone et al. |
| 6,997,094 | B2 | 2/2006 | Granger |
| 7,066,070 | B2 | 6/2006 | Granger et al. |
| D550,517 | S | 9/2007 | Neveu et al. |
| D590,213 | S | 4/2009 | Young et al. |
| 7,975,955 | B2 | 7/2011 | Takeuchi |
| D648,187 | S | 11/2011 | Kuehneman et al. |
| 8,181,899 | B2 | 5/2012 | Marietta-Tondin et al. |
| D705,015 | S | 5/2014 | Wilson, Jr. et al. |
| 8,899,508 | B2 | 12/2014 | Hjort et al. |
| 8,899,509 | B2 | 12/2014 | Hjort et al. |
| 8,939,392 | B2 | 1/2015 | Granger |
| D788,485 | S | 6/2017 | Greenwald et al. |
| D793,819 | S | 8/2017 | Rozek |
| 2004/0256516 | A1 | 12/2004 | Granger |
| 2005/0150898 | A1 | 7/2005 | Young et al. |
| 2005/0156081 | A1 | 7/2005 | Schaeffer |
| 2008/0073371 | A1 | 3/2008 | Neiberger et al. |
| 2012/0241548 | A1 | 9/2012 | Rozek et al. |
| 2013/0221019 | A1 | 8/2013 | Rozek |
| 2014/0263387 | A1 | 9/2014 | Muehl et al. |
| 2016/0000276 | A1 | 1/2016 | Rozek et al. |
| 2016/0037979 | A1 | 2/2016 | Mattheeussen et al. |

FOREIGN PATENT DOCUMENTS

| | | | | |
|---|---|---|---|---|
| WO | WO-2007068884 | A2 * | 6/2007 | ..... A47K 10/38 |
| WO | 2011/149393 | A1 | 12/2011 | |
| WO | 2014118483 | A1 | 8/2014 | |
| WO | 2015088398 | A1 | 6/2015 | |
| WO | 2015088399 | A1 | 6/2015 | |
| WO | 2016029964 | A1 | 3/2016 | |

OTHER PUBLICATIONS

Written Opinion for International Application No. PCT/US2017/015023, mailed by the International Searching Authority dated May 16, 2017.

* cited by examiner

MECHANICAL DISPENSER FOR PERFORATED SHEET PRODUCTS

TECHNICAL FIELD

The present application and the resultant patent relate generally to sheet product dispensers and more particularly relate to mechanical dispensers for perforated sheet products that, among other things, limit or avoid the loss of an adjacent sheet during a dispense.

BACKGROUND OF THE INVENTION

Generally described, sheet product dispensers may include a roll support mechanism configured to rotatably support a roll of sheet product for dispensing the sheet product therefrom. During the use of such dispensers, the user may grasp a tail portion (i.e., an exposed free end portion) of the roll and apply a pull force thereto sufficient to rotate the roll about the roll support mechanism and unwind a length of sheet product from the roll. The user may separate the unwound length of sheet product from the roll by tearing the sheet product along a predefined area of weakness, such as a line of perforations, or elsewhere as desired.

From a user's perspective, a relatively low pull force may be preferred to dispense the sheet product. During an aggressive or a "jerking type" pull, however, the roll may not overcome "at rest" static inertia such that the roll may not rotate at the same speed as the sheet being pulled by the user. As a result, the lead sheet may be separated from the roll before the next tail reaches the dispensing chute. This may be an issue particularly once the diameter of the roll is reduced such that the distance between the roll and the dispensing chute increases and all of the pull forces must be resisted by the perforations in that distance. Similarly, once the roll does develop sufficient inertial rotation, the roll may continue to rotate so as to pull the tail out of the dispensing chute. Another issue may be the angle at which the lead sheet is grasped. If the lead sheet is grasped towards one of the sides, the pull force may be focused at the outer edge so as to initiate a tear that progresses across the perforations before the next tail may be available. Alternatively, if the sheet is pulled along the middle, multiple sheets may be removed before a tear is initiated.

The impact of each of these drawbacks also may vary as the outer diameter of the roll decreases. There is thus a desire for improved sheet product dispensers and methods of providing a single sheet product while ensuring the availability of an adjacent sheet.

SUMMARY OF THE INVENTION

The present application and the resulting patent thus provide a dispenser for a roll of sheet product. The dispenser may include a housing with a first wall, a discharge chute, and a roll support mechanism positioned within the housing. The roll support mechanism forces the roll of sheet product against the first wall at a fixed contact area so as to resist aggressive pull forces.

The present application and the resultant patent further provide a method of dispensing a sheet product from a roll of sheet product in a dispenser. The method may include the steps of positioning the roll within the dispenser in an underfeed orientation, forcing the roll against a wall of the dispenser, pulling a first sheet product through a discharge chute with a restricted width, and separating a number of perforations between the first sheet product and a second sheet product as the perforations pass in or about the restricted width.

The present application and the resultant patent further provide a dispenser for a roll of sheet product. The dispenser may include a top cover with a discharge chute and a biased roll support mechanism. The biased roll support mechanism may include a pair of spring loaded arms sized to accommodate the roll of sheet product for easy self-loading therein.

The present application and the resultant patent further provide a dispenser for a roll of sheet product. The dispenser may include a housing with a first wall, a discharge chute with a restricted width, and a roll support mechanism positioned within the housing. The roll support mechanism forces the roll against the first wall so as to resist aggressive pull forces.

The present application and the resultant patent further provide a method of dispensing sheet product with perforations from a roll of sheet product in a dispenser. The method may include the steps of positioning the roll within the dispenser, pulling a first sheet product in a tangential direction, passing the first sheet product through a discharge chute with a restricted width, and separating a number of perforations between the first sheet product and a second sheet product as the perforations pass in or about the restricted width.

The present application and the resultant patent further provide a method of loading a roll of sheet product into a dispenser. The method may include the steps of placing the roll in a curved cover of the dispenser, biasing a roll support mechanism towards the roll in the curved cover of the dispenser, rolling the roll into the roll support mechanism, and closing the curved cover.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
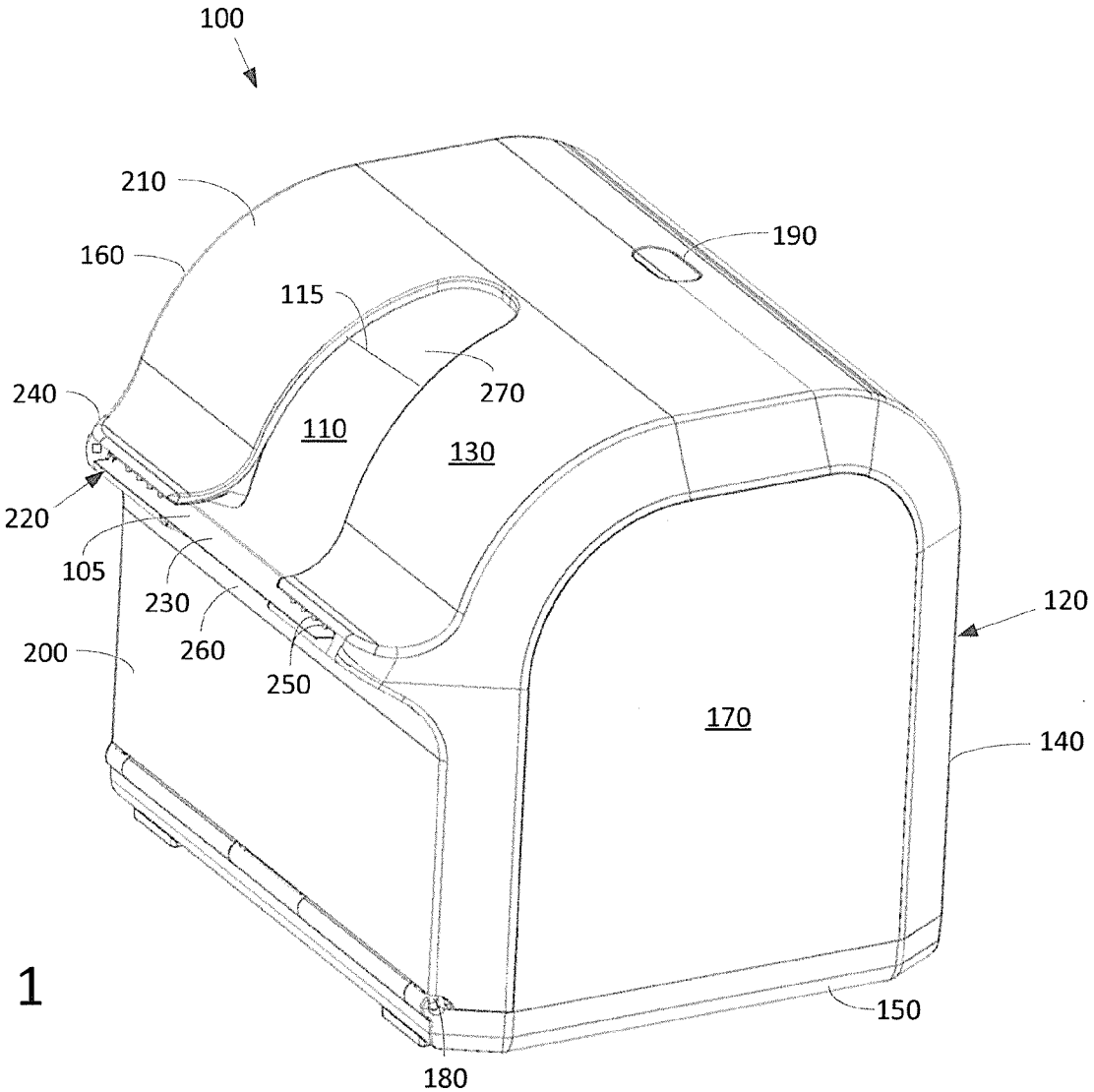
FIG. 1 is a perspective view of a mechanical dispenser as may be described herein.

As used herein, the term "sheet product" is inclusive of natural and/or synthetic cloth or paper sheets. Sheet products may include both woven and non-woven articles. There are a wide variety of non-woven processes for forming sheet products, which can be either wetlaid or drylaid. Examples of non-woven processes include, but are not limited to, hydroentangled (sometimes called "spunlace"), double re-creped (DRC), airlaid, spunbond, carded, papermaking, and melt-blown processes. Further, sheet products may contain fibrous cellulosic materials that may be derived from natural sources, such as wood pulp fibers, as well as other fibrous material characterized by having hydroxyl groups. Examples of sheet products include, but are not limited to, wipers, napkins, tissues, such as bath tissues, towels, such as paper towels, and other fibrous, film, polymer, or filamentary products. In general, sheet products are thin in comparison to their length and width and exhibit a relatively flat planar configuration but are flexible to permit folding, rolling, stacking, and the like. Sheet products may include pre-defined areas of weakness, such as lines of perforations, extending across their width between individual sheets to facilitate separation or tearing of one or more sheets from a roll or folded arrangement of the sheet product at discrete intervals. The individual sheets may be sized as desired to accommodate particular uses of the sheet product.

As used herein, the term "roll of sheet product" refers to a sheet product formed in a roll by winding layers of the sheet product around one another. Rolls of sheet product may have a generally circular cross-sectional shape, a generally oval cross-sectional shape, or other cross-sectional shapes according to various winding configurations of the layers of sheet product. Rolls of sheet product may be cored or coreless.

As used herein, the term "cored roll of sheet product" refers to a roll of sheet product that includes a core positioned therein. In this manner, the layers of the sheet product are wound around a core of paperboard or other material. A cored roll of sheet product includes a central opening extending therethrough along a longitudinal axis of the roll and defined by the core. A cored roll of sheet product may include one or more removable shafts, plugs, or other members positioned within the central opening for structural support during shipping or transportation, which may or may not be removed prior to loading the roll in or on a sheet product dispenser.

As used herein, the term "coreless roll of sheet product" refers to a roll of sheet product that does not include a core positioned therein. In this manner, the layers of the sheet product are not positioned about a core of paperboard or other material. Instead, a coreless roll of sheet product includes a central opening extending therethrough along a longitudinal axis of the roll and defined by an inner layer of the sheet product itself A coreless roll of sheet product may, however, include one or more removable shafts, plugs, or other members positioned within the central opening for structural support during shipping or transportation and removed prior to loading the roll in or on a sheet product dispenser.

As used herein, the term "life of a roll of sheet product" refers to a duration of time over which sheet product is available to be dispensed from a particular roll of sheet product. The roll life begins when sheet product is first available to be dispensed from the roll and ends when all of the sheet product of the roll that can be dispensed from the roll has been dispensed (e.g., excluding the last one or more layers that may be adhered to a core of a cored roll of sheet product).

As used herein, the term "pull force resistance" refers to a resistance opposing a pull force applied by a user to a tail portion of a roll of sheet product to rotate the roll and unwind a length of sheet product from the roll. In this manner, the pull force resistance resists rotation of the roll and unwinding of sheet product from the roll, and the pull force applied by the user must be greater than the pull force resistance in order to dispense sheet product from the roll.

Figure 2:
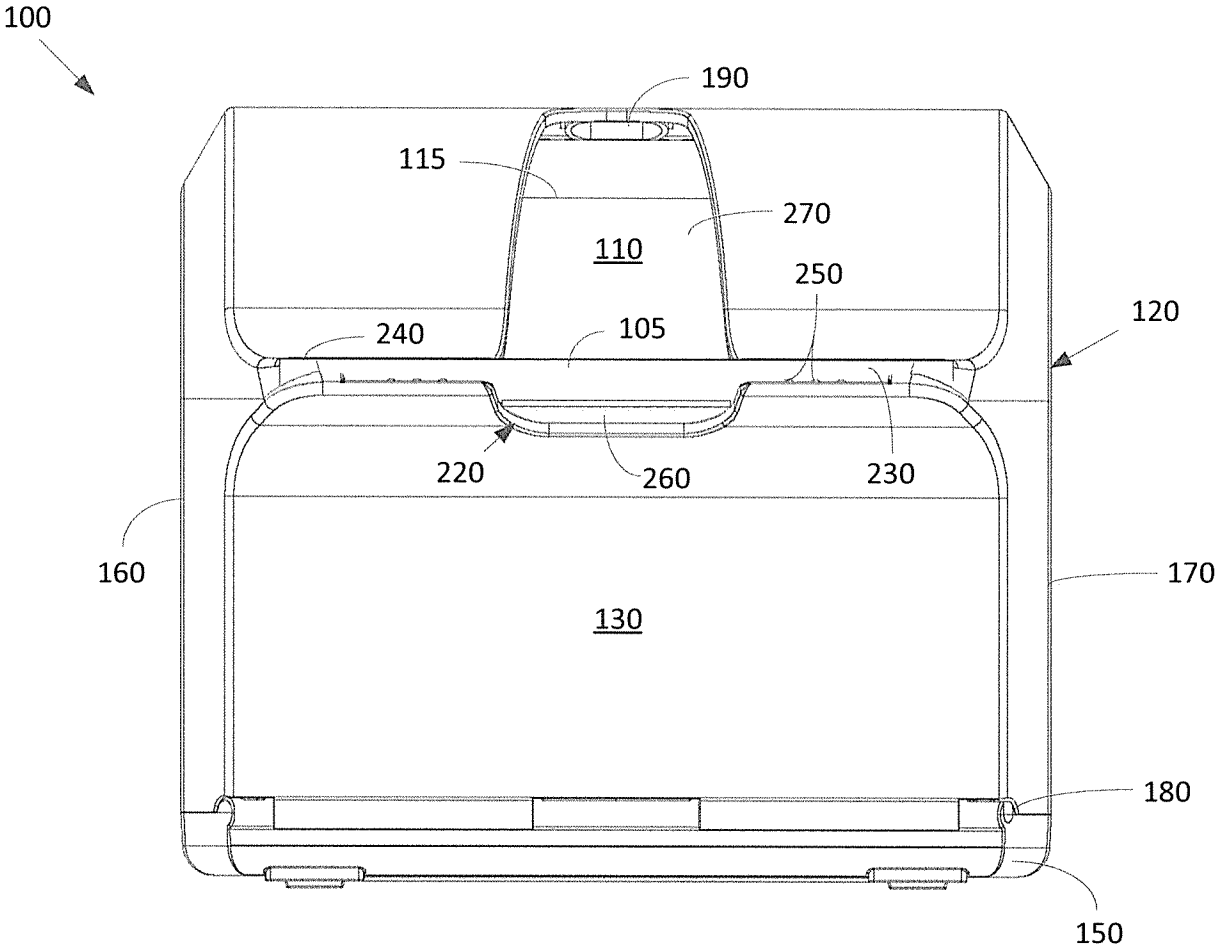
FIG. 2 is a front plan view of the mechanical dispenser of FIG. 1.
Figure 3:
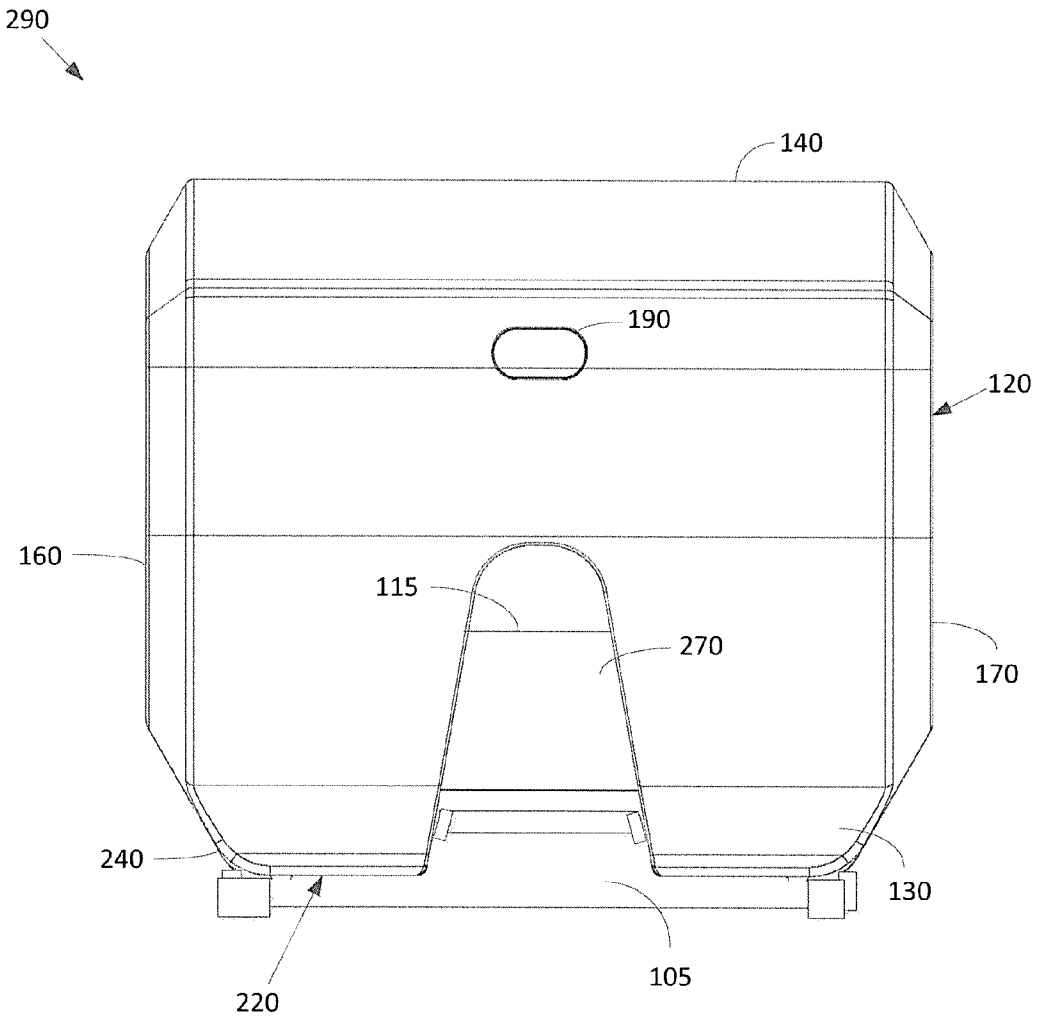
FIG. 3 is a top plan view of the mechanical dispenser of FIG. 1.

Referring now to the drawings, in which like numerals refer to like elements throughout the several views, FIGS. 1-3 show a mechanical dispenser 100 as may be described herein. The mechanical dispenser 100 may be configured to allow a user to obtain a length of a sheet product 105 from a roll 110 of sheet product 105 positioned within the mechanical dispenser 100. The roll 110 of sheet product 105 may be formed in a conventional manner such that layers of the sheet product 105 are wound around one another. The roll 110 of sheet product 105 may be a coreless roll or a cored roll. The sheet product 105 may include predefined areas of weakness, such a line of perforations 115 extending across the width of the sheet product 105 between individual sheets 105 thereof. In this manner, the user may separate one or more sheets 105 from the roll 110 by tearing the sheet product 105 along the perforations 115 in a conventional manner.

The mechanical dispenser 100 may include an outer housing 120. The outer housing 120 may be made from a molded thermoplastic or from any suitable type of substantially rigid materials or combinations thereof. The outer housing 120 may include a first wall or a front cover 130. The outer housing 120 also may include a rear wall 140, a base 150, a first sidewall 160, and a second sidewall 170. The rear wall 140, the base 150, the first sidewall 160, and the second sidewall 170 may be formed as a single element and/or they may be rigidly connected in whole or in part. The outer housing 120, and the components thereof, may have any suitable size, shape, or configuration.

The front cover 130 may be moveable so as to open the outer housing 120 for loading the roll 100 therein. Specifically, the front cover 130 may extend from a pivot rod 180 positioned about the base 150 to a locking mechanism 190 positioned about the rear wall 140. The front cover 130 may be opened by releasing the locking mechanism 190 and pivoting the front cover 130 about the pivot rod 180. The locking mechanism 190 may be of conventional design. The front cover 130 may have a bottom substantially straight portion 200 positioned about the base 150 and a top substantially curved portion 210 positioned about the rear wall 140. The shape of the curved portion 210 may accommodate the expected outer diameter of a full new roll 110 therein. Other components and other configurations may be used herein.

The mechanical dispenser 100 may include a discharge chute 220. The discharge chute 220 may be positioned on the front cover 130 between or about the substantially straight portion 200 and the substantially curved portion 210. The discharge chute 220 may extend outwardly from the front cover 130. The discharge chute 220 may extend outwardly from the front cover 220 at an upward angle along a chute curved portion 225. The angle and length of the chute curved portion 225 may vary.

The discharge chute 220 may define a discharge slot 230 at the end thereof. Although the discharge slot 230 is shown as being substantial flat from one end to the other, the discharge slot 230 also may be curved with an apex being positioned about in the middle or elsewhere. The nature of the curve and the overall shape of the discharge slot 230 may vary.

The discharge chute 220 and/or the discharge slot 230 may have a restricted width 240 therein. Specifically, the restricted width 240 of the discharge slot 230 may be narrower than a width of the sheet product 105 intended to be used therewith. For example, the restricted width 240 of the discharge slot 230 may be a slot width that may be about five percent (5) to about fifty (50) percent smaller than the expected width of the sheet product 105. The size of the restricted width 240 may be based upon the relative properties of the sheet product 105 and the strength of the perforations 115. The restricted width 240 may be progressively smaller along the length of the discharge chute 220 and/or the restricted width 240 may be a blunt obstruction at or about the discharge slot 230. Specifically, the restricted width 240 may be created by limiting the width of the discharge slot 230 or by placing obstructions and the like therein. As will be described in more detail below, the restricted width 240 may promote wrinkling and/or buckling of the sheet product 105 so as to promote the timely bursting of the perforations 115 as the perforations 115 pass through and/or thereabout. (The terms "bursting", "separating", "tearing", "ripping", and like may be used interchangeably herein.) Other dimensions and other configurations may be used herein.

The discharge slot 230 may have a number of protrusions 250 positioned therein. The protrusions 250 may have any suitable size, shape, or configuration. The protrusions 250 may provide additional resistance so as to assist in bursting the perforations 115 in the sheet product 105. The protrusions 250 also may act as one way restraints against the sheet product 105 from being pulled back into the discharge chute 220. In addition to the use of the protrusions 250, reed-type valves, one-way tabs, and the like also may be positioned in the discharge slot 230 and/or elsewhere along the discharge chute 220 so as to limit the sheet product 105 from being pulled back into the discharge chute 220 or into the outer housing 120. Other components and other configurations may be used herein.

The discharge chute 220 may define a lower aperture 260 and/or an upper aperture 270 therein. The apertures 260, 270 may be positioned about the middle of the discharge chute 220 or otherwise. The lower aperture 260 may extend from the discharge slot 230 down for part or all of the length of the discharge chute 220. The upper aperture 270 may extend up the length of the discharge chute 220 and into the substantially curved portion 210 of the front cover 130. The apertures 260, 270 may have any suitable size, shape, or configuration. Specifically, the apertures 260, 270 may be sized so as to permit a user to grasp the leading edge of the sheet product 105 and pull the sheet product through the discharge slot 230 and the discharge chute 220. Other components and other configurations may be used herein.

Figure 4:
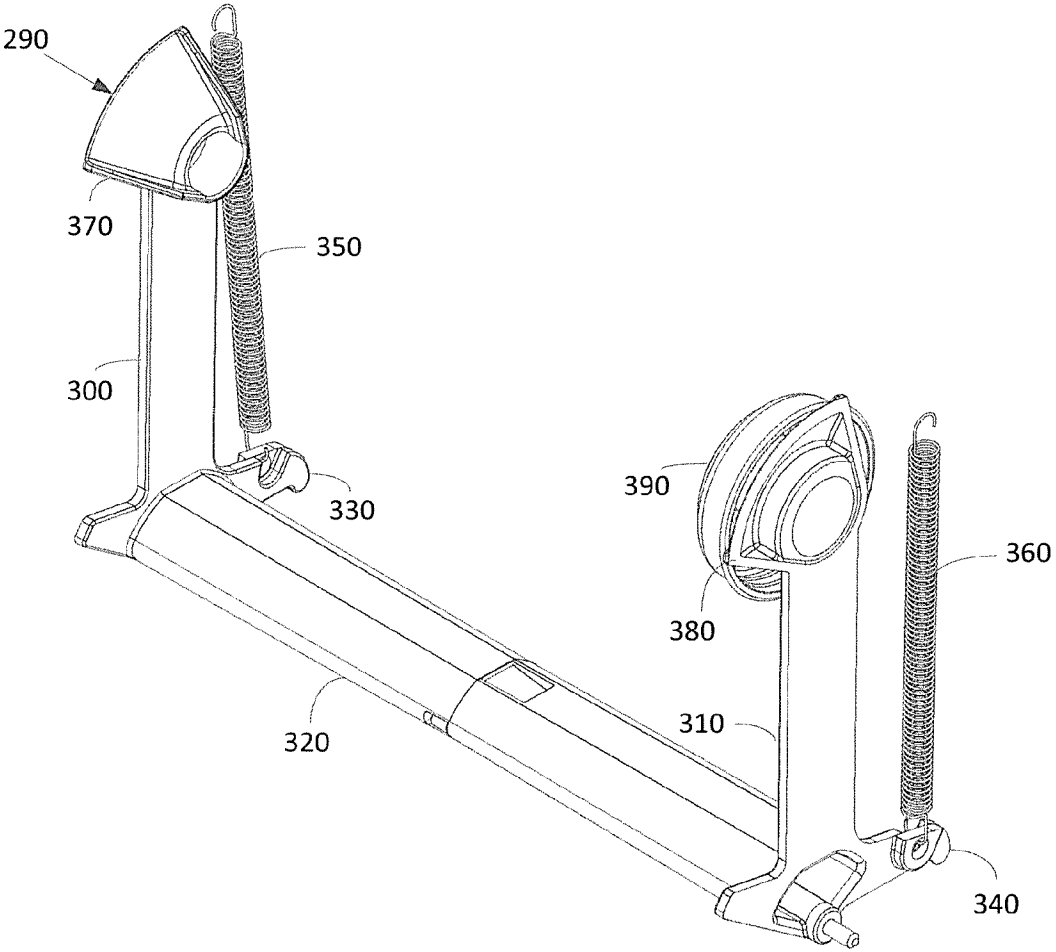
FIG. 4 is a perspective view of a roll support mechanism of the mechanical dispenser of FIG. 1.

The housing 120 of the mechanical dispenser 100 may define an interior roll space 280. The interior roll space 280 may be sized and shaped so as to accommodate the size of a full new roll 110 intended to be used therein. A roll support mechanism 290 may be positioned within the interior roll space 280. As is shown in FIG. 4, one example of the roll support mechanism 290 may include a first arm 300, a second arm 310, and a connecting rail 320 therebetween. The connecting rail 320 may extend from the first sidewall 160 to the second sidewall 170 for pivoting motion therein. In an alternative configuration, the arms 200, 310 may be attached to the sidewalls 160, 170 without the connecting rail 320. Likewise, the pivot feature also may be incorporated into the arms 300, 310 without the use of the connecting rail 320. Other types of roll support structures may be used herein.

Generally described, the first arm 300 may include a first flange 330 and a first spring 350. The second arm 310 may include a second flange 340 and a second spring 360. The springs 350, 360 may be attached to the flanges 330, 340 and to the sidewalls 160, 170 or elsewhere. The springs 350, 360 may bias the roll support mechanism 290 towards the discharge chute 220. Other types of biasing mechanisms also may be used herein. For example, sliding brackets, pivoting arms, and the like also may be used. The first arm 300 may include a first plug cup 370 and the second arm 310 may include a second plug cup 380. The plug cups 370, 380 may be sized for a plug 390 of the roll 110 to slide therein for easy self-loading. Specifically, the plugs 390 of a full new roll 110 may fit into the plug cups 370, 380 and/or otherwise be positioned and supported therein. Alternatively in the context of a coreless roll 110, the arms 300, 310 may have appropriately sized bosses or other types of extensions to support the roll 110 therein without the use of the plug cups 370, 380. Other components and other configurations may be used herein.

Figure 5:
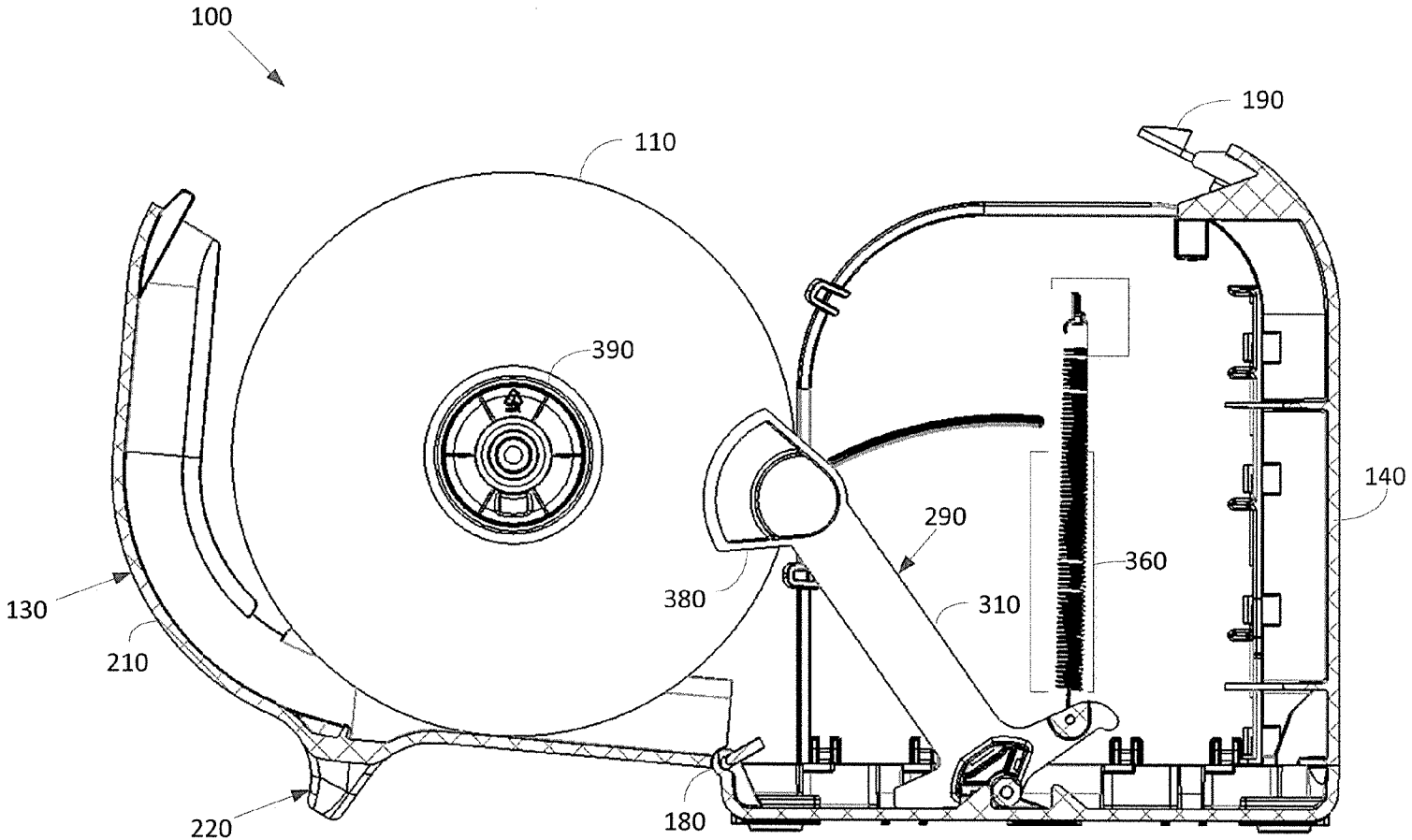
FIG. 5 is a side cross-sectional view of the mechanical dispenser of FIG. 1 with a full roll and an open front cover.

In use, the front cover 130 of the mechanical dispenser 100 may be opened as is shown in FIG. 5. Specifically, the user may release the locking mechanism 190 and swing the front cover 130 open along the pivot rod 180. In the open position, the substantially curved portion 210 of the front cover 130 accommodates the size of a full new roll 110 intended to be used therein. The springs 350, 360 of the roll support mechanism 290 may bias the arms 300, 310 forward in the direction of the roll 110. The roll 110 thus may roll towards the roll support mechanism 290 with the plugs 390 of the roll 110 sliding within the plug cups 370, 380 for easy self-loading as the front cover 130 is closed. The roll 110 may be installed in an underfeed orientation such that the leading edge of the sheet product 105 may be fed from the bottom of the roll 110. The leading edge of the sheet product 105 may be pulled through the discharge chute 220 and the front cover 130 may be closed and locked. The mechanical dispenser 100 is now ready for dispensing.

Figure 6:
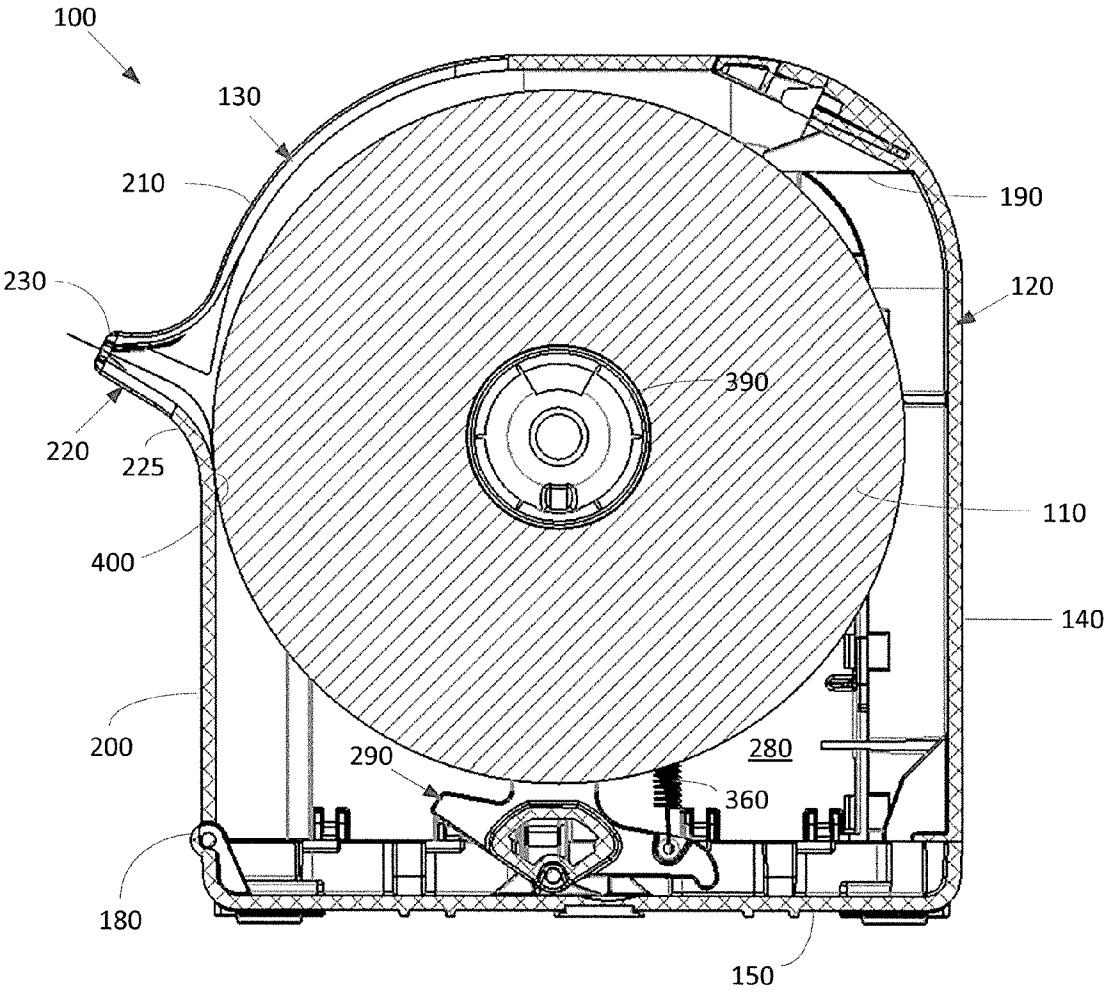
FIG. 6 is a side cross-sectional view of the mechanical dispenser of FIG. 1 with a full roll.
Figure 7:
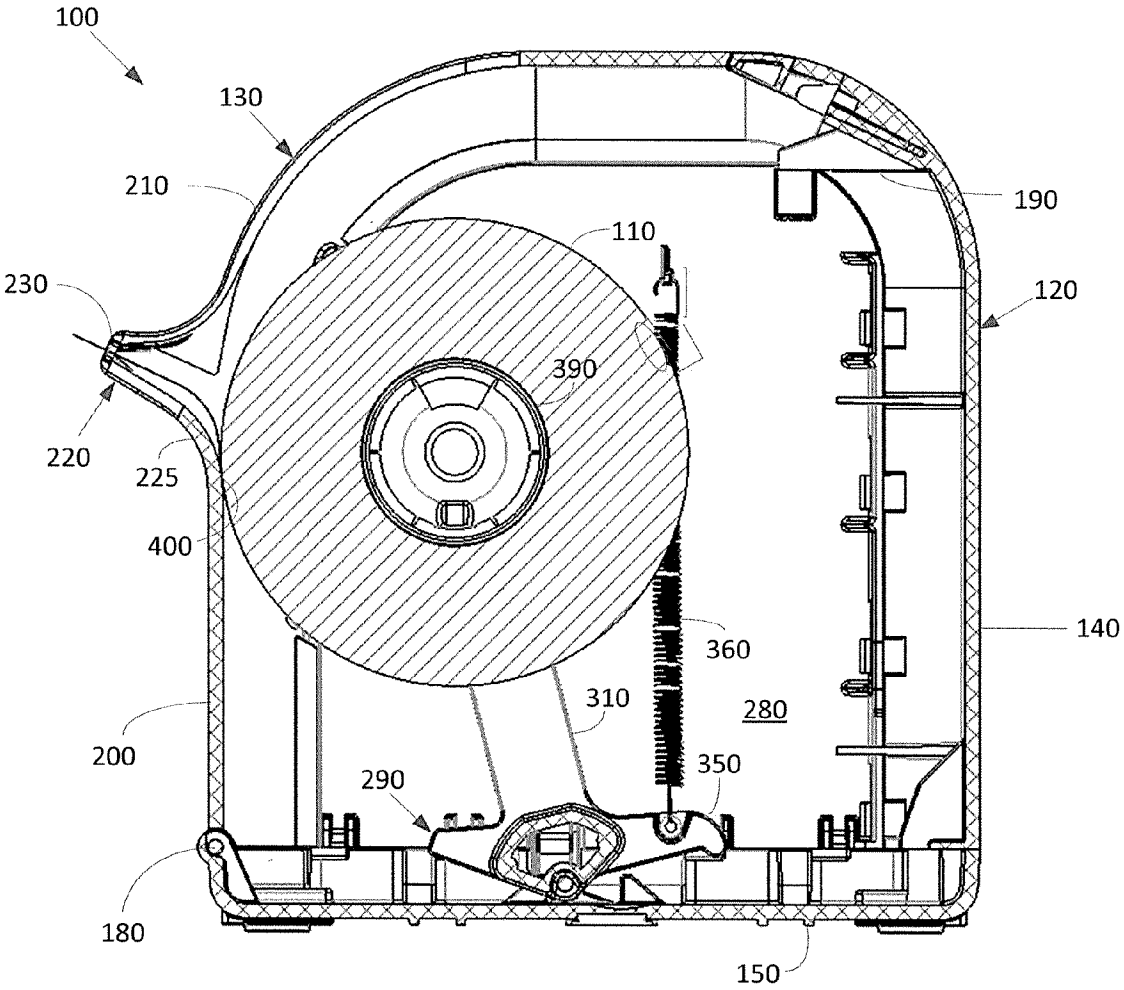
FIG. 7 is a side cross-sectional view of the mechanical dispenser of FIG. 1 with a partially depleted roll.
Figure 8:
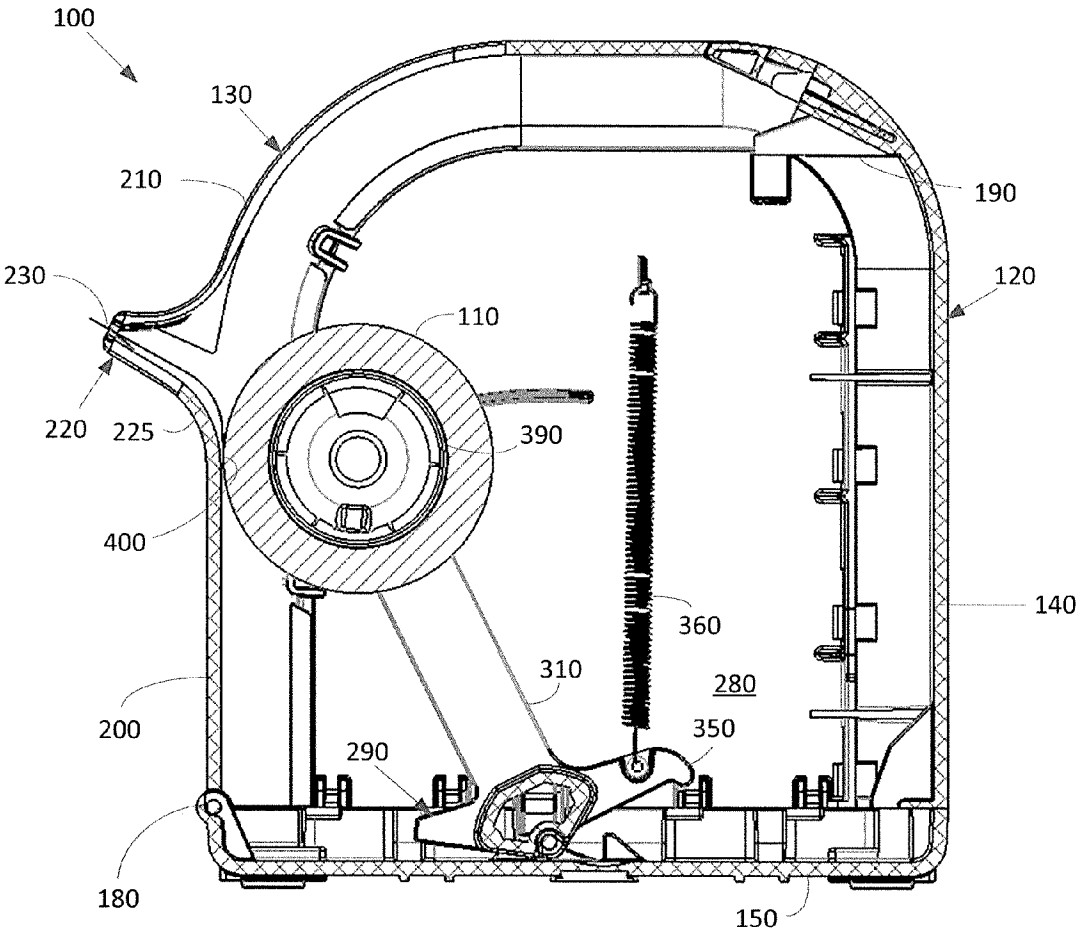
FIG. 8 is a side cross-sectional view of the mechanical dispenser of FIG. 1 with a partially depleted roll.

As is shown in FIGS. 6-8, the roll support mechanism 290 forces the roll 110 against the inside of the front cover 130. Specifically, the roll support mechanism 290 may force the roll 110 into contact with the front cover 130 at a fixed contact area 400. The fixed contact area 400 may be at a predetermined distance from the discharge chute 220 and the discharge slot 230 along a length of the substantially straight portion 200 and a length of the chute curved portion 225 of the front cover 130. The leading sheet product 105 thus may extend from the fixed contact area 400 along the substantially straight portion 200 and then bend into the chute curved portion 225 of the discharge chute 220 towards the discharge slot 230. Force may be applied to the roll 110 in other ways including the force of gravity.

During the dispensing of the sheet product 105, any abrupt jerking forces may be substantially absorbed by the length of the sheet product 105 within the chute curved portion 225 of the discharge chute 220 without being translated to the perforations 115 below the fixed contact area 400. Keeping any such abrupt forces localized above the fixed contact area 400 thus may prevent the sheet product 105 from separating before the next sheet product 105 extends into the discharge chute 220. This separation protection may be particularly useful at the start of a pull so as to allow the roll 110 to overcome the "at rest" static inertia. Likewise, the use of the underfed orientation of the roll 110 may allow the pull force resistance to be lower given that any over spin may be directed towards the top of the housing 120. The underfed orientation of the roll 110 also assists in maintaining the roll 110 in contact along the fixed contact area 400 during a pull. Other suitable locations of the fixed contact area 400 are contemplated.

The roll support mechanism 290 maintains the roll 110 in contact with the fixed contact area 400 as the diameter of the roll 110 is reduced. The roll support mechanism 290 thus may assist in maintaining pull force resistance on a stationary leading sheet product regardless of the diameter of the roll 110. As the diameter of the roll 110 is reduced, the corresponding spring force also may be reduced as the springs 350, 360 relax. The pull force resistance may be based on the interrelationship of the diameter of the roll 110, the weight of the roll 110 resting against the fixed contact area 400, the spring forces, and the overall housing geometry. Other components and other configurations may be used herein.

The discharge slot 230 of the discharge chute 220 may be a set distance from the fixed contact area 400. This set distance assists in providing a leading edge of the sheet product 105 in or through the discharge slot 230 or within the apertures 260, 270 of the discharge chute 220. The apertures 260, 270 of the discharge chute 220 allow the leading edge of the sheet product 105 to be pulled therethrough without having to open the front cover 130 to gain access to the tail.

As the perforations 115 of the sheet product 105 pass through the restricted width 240, the sheet product 105 may begin to wrinkle or buckle such that high stresses may be created on the outer most perforations. These high stresses may induce the perforations 115 to start bursting at one or both of the outer edges. This bursting may continue towards the center or the opposite end of the sheet product 105 and eventually may result in the separation of the sheet product 105 along the perforation line 115 as the next sheet product 105 is pulled into the dispensing chute 220.

The use of the roll support mechanism 290 and the restricted width 240 of the discharge chute 220 thus may prevent premature separation of the sheet products 105 before the presentation of the next sheet product 105. Specifically, the restricted width 240 of the discharge chute 220 promotes bursting of the perforations 115 along at least part of the length of the discharge chute 220 and hence as the next sheet becomes available. Likewise, the apertures 260, 270 provide sufficient space to allow user to grasp the next sheet if the sheet does not extend beyond the chute 220. The contact of the roll 110 at the fixed contact area 400 by the roll support mechanism 290 reduces the forces on the following perforations 115 so as to aid in keeping the remaining sheet products 105 intact. The mechanical dispenser 100 thus promotes the easy and efficient dispense of a single sheet regardless of the pull forces thereon.

Figure 9:
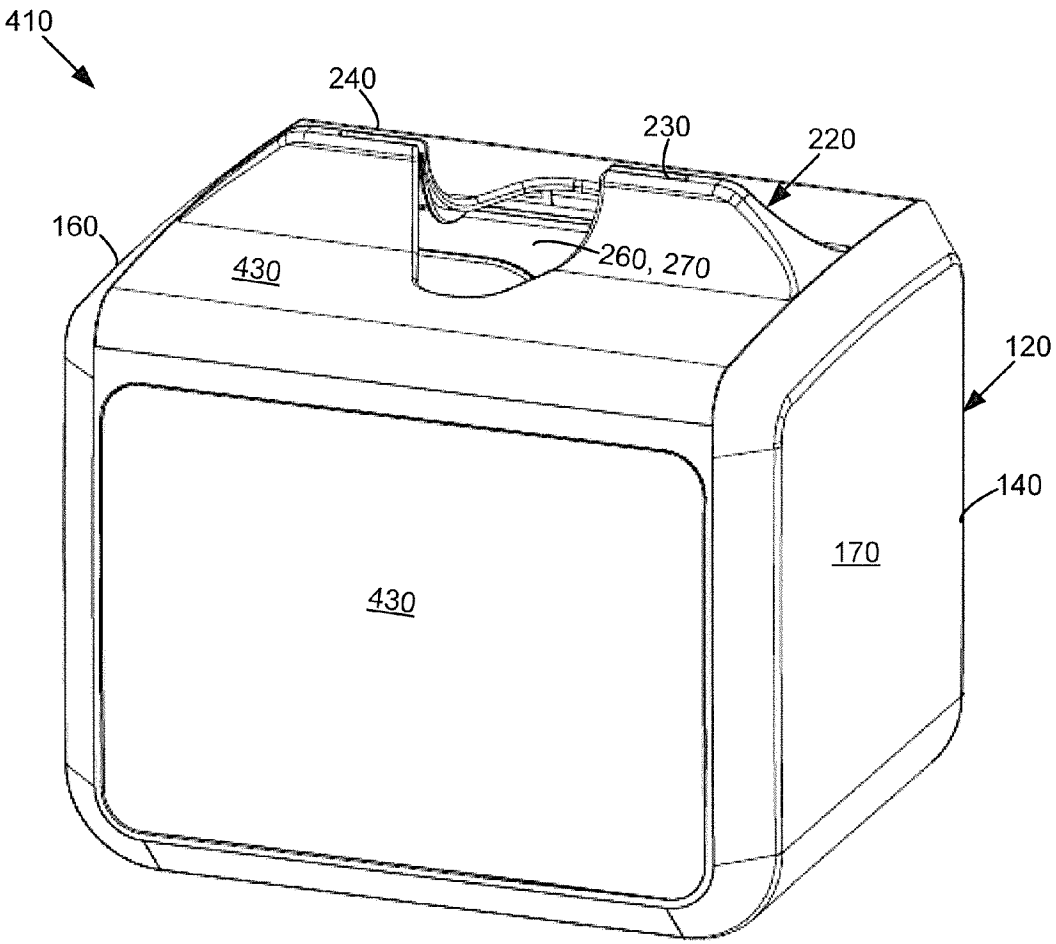
FIG. 9 is a perspective view of an alternative embodiment of a mechanical dispenser as may be described herein.
Figure 10:
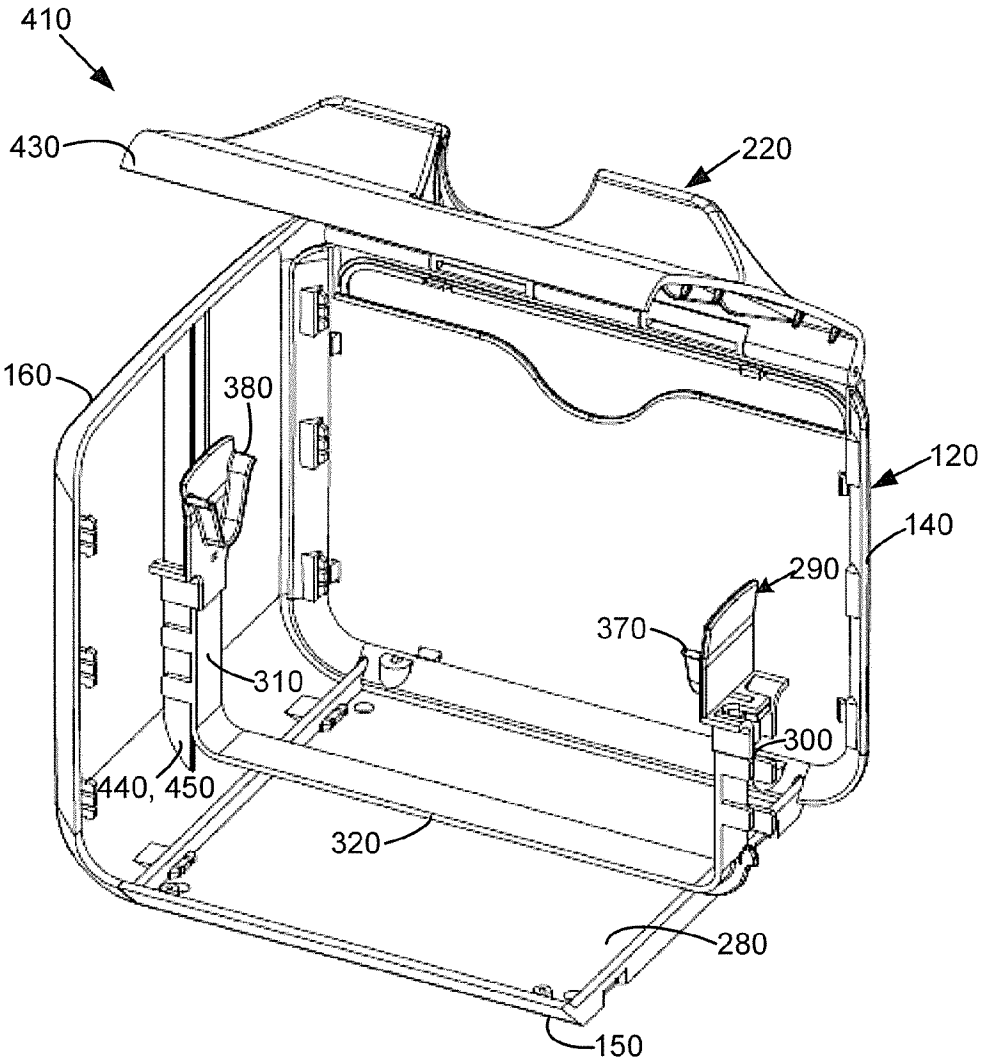
FIG. 10 is a partial perspective view of an interior of the mechanical dispenser of FIG. 9.

FIGS. 9 and 10 show an alternative embodiment of a mechanical dispenser 410 as may be described herein. Instead of the front cover 130 with the substantially straight portion 200 and the substantially curved portion 210, the mechanical dispenser 410 may include a top cover 420. The outer housing 120 thus may have the top cover 420, a front wall 430, the rear wall 140, the base 150, the first sidewall 160, and the second sidewall 170. The top cover 420 may extend from the front wall 430 to the rear wall 140 in a first direction and from the first sidewall 160 to the second sidewall 170 in a perpendicular second direction. The top cover 420 may pivot open and shut about the pivot rod 180. In this example, the pivot rod 180 may be position about the top of the rear wall 140. Other pivot positions also may be used.

The discharge chute 220 may be positioned about a middle of the top cover 420. The discharge chute 220 may be similar to that described above and may extend upwardly from the top cover 420. The discharge chute 220 may include the discharge slot 230 with the restricted width 240 therein. The discharge chute 220 may include the lower aperture 260 and the upper aperture 270 therein. Other components and other configurations may be used herein.

The outer housing 120 may define the interior roll space 280 therein. The interior roll space 280 may include the roll support mechanism 290 therein. The roll support mechanism 290 may include on or more arms. In this example, the first arm 300 with the first plug cup 370, the second arm 310 with the second plug cup 380, and the connecting rail 320 therebetween. Any number of arms 300, 310 may be used herein. The arms 300, 310 may be maneuverable up and down along a first rail 440 position on or about the first sidewall 160 and a second rail 450 positioned on or about the second sidewall 170. The rails 440, 450 may extend from the base 150 to the top cover 420 about the middle of the sidewalls 160, 170. One or more springs 350, 360, either extension or compression, may bias the roll support mechanism 290, and hence the roll 110, upward against the top cover 410. Any number of the springs 350, 360 may be used herein. Other types of biasing members may be used herein. Other components and other configurations may be used herein.

In use, the top cover 410 may be opened and the roll 110 may be dropped into the roll support mechanism 290. The leading edge of the roll 110 may be extended through the discharge chute 220 and the top cover 410 may be closed. The springs 350, 360 bias the roll into contact with the top cover 410 with a fixed contact area 400 on either or both sides of the discharge chute 220. The restricted width 240 of the discharge slot 230 assists in bursting the perforations 115 as is described above. The vertical orientation of the discharge chute 220 on the top cover 410 also may promote an angled pull as the user grasps the leading edge of the sheet product 105.

Figure 11:
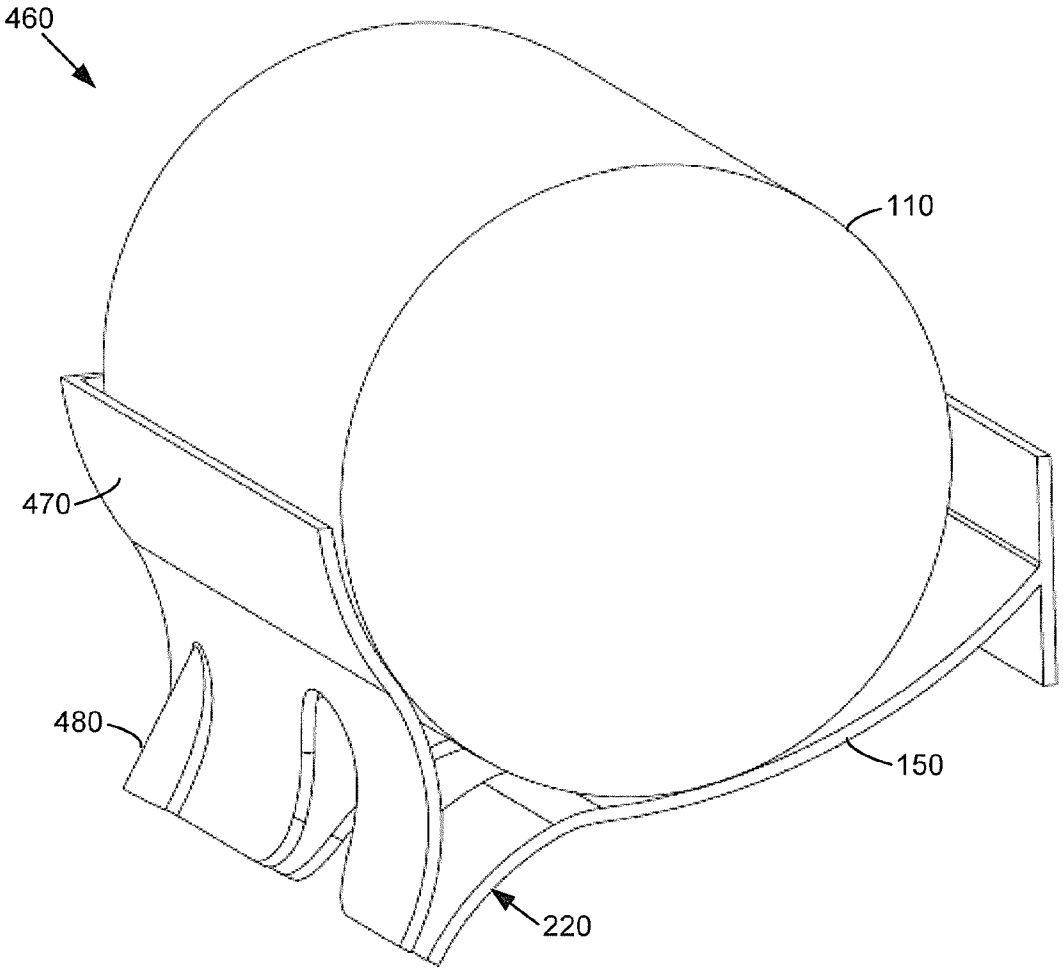
FIG. 11 is a perspective view of an alternative embodiment of a portion of a mechanical dispenser as may be described herein.

FIG. 11 shows an alternative embodiment of a portion of a mechanical dispenser 460 as may be described herein. In this example, the mechanical dispenser 460 may have the discharge chute 220 positioned about a bottom half of a front wall 470 of the outer housing 120. The discharge chute 220 thus may have a downwardly angled configuration 480. The discharge chute 220 may be similar to that described above and may include the discharge slot 230 with the restricted width 240 therein. The discharge chute 220 may include the lower aperture 260 and the upper aperture 270 therein. Other components and other configurations may be used herein.

The mechanical dispenser 460 as illustrated may not include the roll support mechanism 290 therein. Rather, the roll 110 may be dropped into interior space 280 about the base 150. The mechanical dispenser 460 thus relies on gravity to bias the roll 110 against a fixed contact area 400 about the base 150. Springs or other types of biasing devices and other mechanisms also may be used. The roll 100 may be positioned in the underfeed orientation such that the leading edge of the sheet product 105 may be fed from the bottom of the roll 110. As above, the restricted width 240 of the discharge slot 230 assists in bursting the perforations 115 as the leading edge of the sheet product 105 is pulled from the discharge chute 220. Other components and other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A dispenser for a roll of sheet product, comprising:
a housing;
the housing comprising a first wall;
the first wall comprising a discharge chute; and
a roll support mechanism positioned within the housing;
the roll support mechanism forcing the roll against the first wall at a fixed contact area.

2. The dispenser according to claim 1, wherein the housing comprises a front cover.

3. The dispenser according to claim 1, wherein the first wall comprises a substantially curved portion sized to accommodate the roll.

4. The dispenser according to claim 3, wherein the first wall comprises a substantially straight portion adjacent to the substantially curved portion and wherein the fixed contact area is positioned about the substantially curved portion and the substantially straight portion.

5. The dispenser according to claim 1, wherein the discharge chute comprises a chute curved portion about the fixed contact area.

6. The dispenser according to claim 1, wherein the discharge chute comprises a discharge slot at an end thereof.

7. The dispenser according to claim 1, wherein the discharge chute comprises one or more protrusions therein.

8. The dispenser according to claim 1, wherein the discharge chute comprises a restricted width therein.

9. The dispenser according to claim 8, wherein the restricted width comprises a slot width that is less than a roll width.

10. The dispenser according to claim 1, wherein the discharge chute comprises one or more apertures therein.

11. The dispenser according to claim 10, wherein the one or more apertures comprise an upper aperture and wherein the upper aperture extends into the first wall.

12. The dispenser according to claim 1, wherein the roll support mechanism comprises at least one biasing member to bias the roll against the fixed contact area.

13. The dispenser according to claim 1, wherein the roll support mechanism comprises a pair of arms for supporting the roll therebetween.

14. The dispenser according to claim 13, wherein each of the pair of arms comprises a plug cup thereon sized to accommodate a plug of the roll.

15. The dispenser according to claim 13, wherein the roll support mechanism comprises a pair of rails for the pair of arms to maneuver thereon.

16. The dispenser according to claim 13, wherein the roll support mechanism comprises one or more springs in communication with the pair of arms.

17. The dispenser according to claim 1, wherein the first wall comprises a front cover.

18. The dispenser according to claim 1, wherein the first wall comprises a top cover.

19. The dispenser according to claim 1, wherein the first wall comprises a front wall.

20. A method of dispensing sheet product from a roll of sheet product in a dispenser, comprising:
positioning the roll within the dispenser in an underfeed orientation;
forcing the roll against a wall of the dispenser;
pulling a first sheet product through a discharge chute with a restricted width; and
separating a number of perforations between the first sheet product and a second sheet product as the number of perforations pass in or about the restricted width.

21. A dispenser for a roll of sheet product, comprising:
a housing;
the housing comprising a first wall;
the first wall comprising a discharge chute;
the discharge chute comprising a restricted width; and
a roll support mechanism positioned within the housing;
the roll support mechanism forcing the roll against the first wall.

22. The dispenser according to claim 21, wherein the first wall comprises a front cover.

23. The dispenser according to claim 21, wherein the discharge chute comprises a discharge slot at an end thereof.

24. The dispenser according to claim 23, wherein the restricted width is positioned about the discharge slot.

25. The dispenser according to claim 23, wherein the discharge slot comprises one or more protrusions therein.

26. The dispenser according to claim 21, wherein the restricted width comprises a slot width that is less than a roll width.

27. The dispenser according to claim 21 wherein the discharge chute comprises one or more apertures therein.

28. The dispenser according to claim 27, wherein the one or more apertures comprise an upper aperture and wherein the upper aperture extends into the first wall.

29. A method of dispensing sheet product with perforations from a roll of sheet product in a dispenser, comprising:
positioning the roll within the dispenser;
pulling a first sheet product in a tangential direction away from the roll;
passing the first sheet product through a discharge chute with a restricted width;
forcing the roll against a wall of the dispenser; and
separating a number of perforations between the first sheet product and a second sheet product as the number of perforations pass in or about the restricted width.

30. A method of loading a roll of sheet product into a dispenser, comprising:
placing the roll in a curved cover of the dispenser;
biasing a roll support mechanism towards the roll in the curved cover of the dispenser;
rolling the roll into the roll support mechanism; and
closing the curved cover.

* * * * *